US007882906B1

(12) United States Patent
DeCuir, Sr.

(10) Patent No.: US 7,882,906 B1
(45) Date of Patent: Feb. 8, 2011

(54) UP-DOWN VIBRATORY DRILLING AND JARRING TOOL

(76) Inventor: Perry Joseph DeCuir, Sr., 4713 Loreauville Rd., New Iberia, LA (US) 70562

( * ) Notice: Subject to any disclaimer, the term of this patent is extended or adjusted under 35 U.S.C. 154(b) by 0 days.

(21) Appl. No.: 12/611,243

(22) Filed: Nov. 3, 2009

(51) Int. Cl.
*E21B 4/10* (2006.01)
*E21B 4/06* (2006.01)

(52) U.S. Cl. ..... 175/306; 175/298; 173/104; 173/205; 166/178

(58) Field of Classification Search ..... None
See application file for complete search history.

(56) References Cited

U.S. PATENT DOCUMENTS 1,542,319 A * 6/1925 Pyles ..... 175/306
2,065,262 A * 12/1936 Barkelew et al. ..... 175/300
2,098,491 A * 11/1937 Foster et al. ..... 175/304
2,146,454 A * 2/1939 Sutliff ..... 175/298
2,153,882 A * 4/1939 Erwin ..... 175/296
2,153,883 A * 4/1939 Poster ..... 175/298
2,326,394 A * 8/1943 Richey ..... 175/294
2,572,307 A * 10/1951 Brown et al. ..... 175/325.3
2,618,466 A * 11/1952 Bagnell et al. ..... 175/298
2,665,887 A * 1/1954 Shelton ..... 175/295
2,739,654 A * 3/1956 Kinley et al. ..... 175/305
3,075,590 A * 1/1963 Cook ..... 175/295
3,388,755 A * 6/1968 Webb ..... 175/297
3,716,109 A * 2/1973 Griffith ..... 175/297
3,834,471 A * 9/1974 Bottoms ..... 175/304
3,853,187 A * 12/1974 Sutliff et al. ..... 175/297
3,880,249 A * 4/1975 Anderson ..... 175/302
4,109,736 A * 8/1978 Webb et al. ..... 175/297
4,181,186 A * 1/1980 Blanton ..... 175/297
4,361,195 A * 11/1982 Evans ..... 175/297
4,434,863 A * 3/1984 Garrett ..... 175/321
4,662,460 A * 5/1987 Loeb et al. ..... 175/305
4,694,917 A * 9/1987 Heidemann et al. ..... 175/299
4,889,198 A * 12/1989 Buck ..... 175/304
5,327,982 A * 7/1994 Trahan et al. ..... 175/304
5,476,148 A * 12/1995 LaBonte ..... 175/27
5,624,001 A * 4/1997 Evans ..... 175/299
5,875,842 A * 3/1999 Wyatt ..... 166/178
5,906,239 A * 5/1999 Oettli ..... 166/178
5,931,242 A * 8/1999 Oettli ..... 175/296

(Continued)

*Primary Examiner*—Rinaldi I. Rada
*Assistant Examiner*—Lindsay Low
(74) *Attorney, Agent, or Firm*—Lemoine & Associates LLC

(57) ABSTRACT

A drilling and vibratory jarring device is provided. The device has an inner mandrel shiftable upward or downward in an outer housing from an intermediate position in the outer housing. When the inner mandrel is in the intermediate position within the outer housing mating splines, one set of splines attached to inner mandrel, the other set of splines attached to the outer housing, engage and rotatably lock inner mandrel and outer housing together. When the inner mandrel is shifted to the upward position said splines disengage and the saw-tooth surfaces of an upper pair of jars engage creating longitudinal vibratory forces down-hole when inner mandrel is rotated with respect to outer housing. When the inner mandrel is shifted to the downward position said splines disengage and the saw-tooth surfaces of an lower pair of jars engage creating longitudinal vibratory forces down-hole when inner mandrel is rotated with respect to outer housing. The device may thus be in a drill string during normal, rotary drilling operations or by shifting mandrel upward or downward used to create longitudinal vibratory forces down-hole an earth bore.

8 Claims, 2 Drawing Sheets

U.S. PATENT DOCUMENTS 6,202,767 B1 * 3/2001 Friis ..... 175/297
6,328,101 B1 * 12/2001 Friis ..... 166/178
6,530,429 B2 * 3/2003 Howlett ..... 166/173
6,745,836 B2 * 6/2004 Taylor et al. ..... 166/301
7,234,544 B2 * 6/2007 Kent ..... 175/74

* cited by examiner

UP-DOWN VIBRATORY DRILLING AND JARRING TOOL

BACKGROUND

1. Field of the Invention

The invention herein disclosed is a multipurpose tool for use in the field of earth boring. It is a tool designed to be installed in a drilling string to selectively enable various forces to be applied to the drill bit without having to pull the drill string ("trip the pipe") from the hole. Namely by varying the amount and direction of vertical forces applied to the drill string the operator of the drilling rig can selectively cause the tool of the present invention to apply torque or a combination of torque and vibratory impacts either (as selected) downwardly or upwardly.

2. Description of Related Art

In the field of earth boring various earth formations, some relatively easy to drill and some relatively difficult to drill are encountered. In some of these earth formations application of weight and rotary forces to the drill bit is sufficient to cause drilling to proceed at an acceptable rate. However with respect to certain formations a greater rate of penetration can be achieved by a combination of weight, rotary forces and vibratory impacts is applied to the drill bit. It is therefore desirable to be able to selectively chose whether drilling of a particular formation might be best achieved with only weight and torque or a combination of weight, torque and vibratory impacts should be employed. It would be undesirable (both expensive and time consuming) to be required to pull the drill string from the hole ("trip the pipe") in order to manually, at the surface of the earth, install or shift some apparatus, in order to shift between said drilling modes. The tool of the present invention allows drilling operations to be shifted between said drilling modes without having to pull the drill string from the hole. By increasing weight on bit the tool of the present invention shifts into a mode which transmits weight, torque and vibratory impacts down-hole (ultimately to the bit at the bottom of the hole).

Not only in the field of drilling are various earth formations encountered (therefore making it desirable, during drilling ahead operations, to be able to selectively shift between the modes indicated above) at times drilling ahead may not be able to proceed because the bit becomes stuck. In such cases application of vibratory forces, sometimes downward, sometimes upward, sometimes alternatively working the drill pipe upward and downward while applying vibratory forces to the bit may be able to free the bit and allow drilling to proceed ahead. The tool of the present invention allows for the selective application of rotary, or a combination of rotary and vibratory impacts to be applied in the upward or downward (as selected direction) therefore is useful in freeing stuck bits.

So far as applicant is aware prior art does not disclose a tool that may be shifted between all four modes, namely a "weight and torque" mode, a "weight, torque and vibratory impacts" mode, a "lifting and torque" mode and a "lifting, torque and vibratory impact" mode, without being required to trip the drill pipe from the hole.

OBJECTS OF THE INVENTION

The general object of the invention are to provide a tool to facilitate earth boring operations. More particularity an object of the invention is to provide a tool which may be disposed in a string of drill pipe during drilling operations, which tool may be selectively shifted between various modes which may be useful in drilling operations. With more particularity an object of the invention is to provide a tool which may be selectively shifted between various modes, namely a "weight and torque" mode, a "weight, torque and vibratory impacts" mode, a "lifting and torque" mode and a "lifting, torque and vibratory impact" mode, without being required to trip the drill pipe from the hole.

SUMMARY OF THE INVENTION

The above and further objects are achieved in accordance with the present invention wherein there is provided a cylindrical outer housing in which is an inner mandrel may be shifted upwardly of downwardly from an intermediate position. In the intermediate position a plurality of splines on the inner surface of the outer housing engage plurality of splines on the outer surface of the inner mandrel, preventing rotation of the inner mandrel with respect to the outer housing.

When the inner mandrel is shifted upward (from said intermediate position), by lifting on the drill string, said splines disengage, a pair of donut shaped up-jars (which have a plurality of mating teeth) engage. One of said pair of jars is attached to the inner mandrel the other to the outer housing. When so engaged the application of upward forces (lifting of the drill string) and sufficient torque to the inner mandrel drill string will cause the teeth of the jars to "slip" over each other and generate vibratory impacts (in addition to upward force and torque applied to the inner mandrel).

When the inner mandrel is shifted downward (from said intermediate position) by applying sufficient weight on the drill string, the splines of the outer housing and inner mandrel also disengage and a pair of donut shaped down-jars (which have a plurality of mating teeth) engage. One of said pair of jars is attached to the inner mandrel the other to the outer housing. When so engaged the application of downward forces (weight on the drill string) and sufficient torque to the inner mandrel drill string will cause the teeth of the jars to "slip" over each other and generate vibratory impacts (in addition to downward force and torque applied to the inner mandrel).

One or more springs and/or shear pins may be employed to prevent movement of the inner mandrel from the intermediate position until a selected longitudinal force is applied to the inner mandrel. A longitudinal bore of the inner mandrel and at the lower end of the outer housing allows for the passage of drilling fluid. Sealing mean, well known to those skilled in the art, would be provided to prevent leakage of drilling fluid. Means, known to those skilled in the art, would be provided to couple the exterior end of the inner mandrel and the opposite end of the outer housing to adjacent components of the drill string.

In summary the tool of the present invention is designed to be installed in a drill string where it may be thereafter be selectively shifted between the normal (torque and weight on bit) drilling mode, an enhanced (torque, weight on bit and vibratory impact) drilling mode, as a down-jar and as an up-jar without having to trip drill pipe from the hole.

BRIEF DESCRIPTION OF THE DRAWINGS

The invention may be better understood by reference to the accompanying drawings wherein.

DESCRIPTION OF THE PREFERRED EMBODIMENT OF THE INVENTION

While the present invention will be described with reference to preferred embodiments, it will be understood by those who are skilled in the art that various changes may be made and equivalents may be substituted for elements thereof without departing from the scope of the invention. In addition, many modifications may be made to adapt a particular situation or material to the teachings of the invention without departing from the essential scope thereof. It is therefore intended that the present invention not be limited to the particular embodiments disclosed as the best mode contemplated for carrying out this invention, but that the invention will include all embodiments and legal equivalents thereof.

The invention herein disclosed relates to apparatus which may be selectively used to impart vibratory impact forces to apparatus disposed in an earth bore. This is sometimes useful to enhance rotary drilling. This is sometimes useful if apparatus in an earth bore becomes stuck. In some cases it may desirable for vibratory impact forces to be generated while downward force is being applied to the drill bit (enhanced drilling or down-jarring). In some cases it may be desirable for vibratory impact forces to be generated while upward force is being applied to the drill bit (up-jarring). In some cases it may be desirable that no impact forces be generated ("no-jarring"). The invention herein disclosed is designed to be selectively operated in each of said mode without having to trip pipe from the earth bore.

Figure 1:
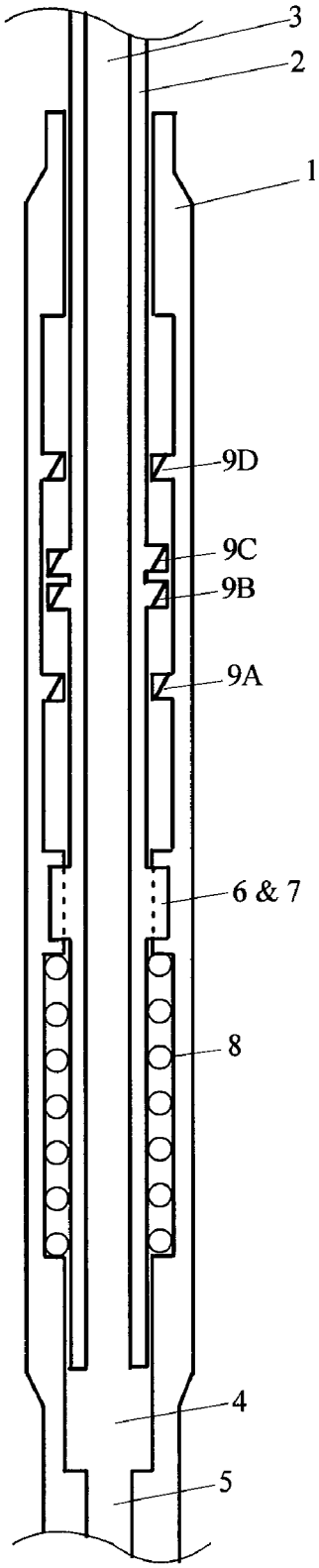
FIG. 1 represents a longitudinal cross section of the tool of the present invention with the inner mandrel in its intermediate (normal, rotary drilling) position. In this position inner splines of the outer housing are engaged with outer splines of the inner mandrel, preventing rotation between the outer housing and inner mandrel.
Figure 3:
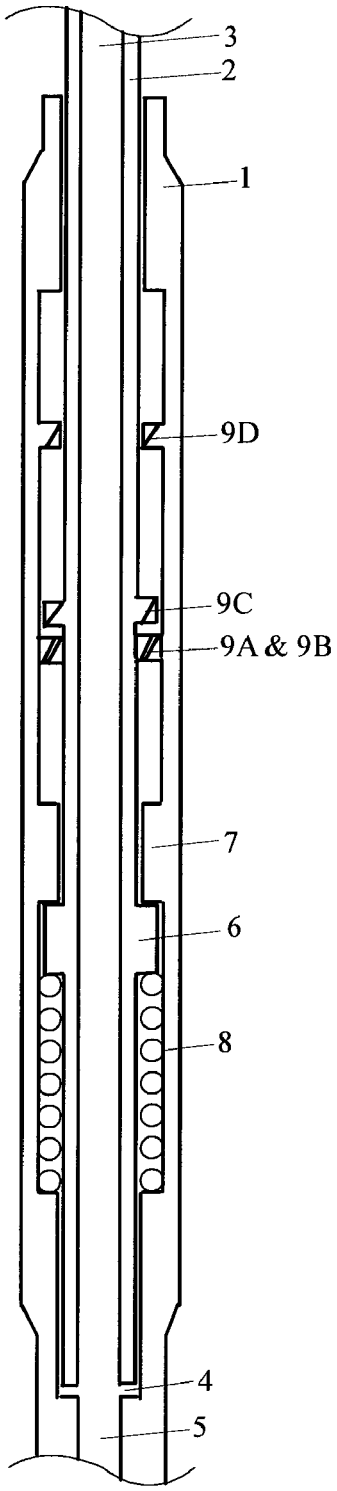
FIG. 3 represents a longitudinal cross section of the tool of the present invention with the inner mandrel in its downward (enhanced drilling and down-jarring) position. In this position inner splines of the outer housing are disengaged with outer splines of the inner mandrel and the pair of toothed down-jars are engaged, creating vibratory impacts when the inner mandrel is rotated with respect to the outer housing.
Figure 4:
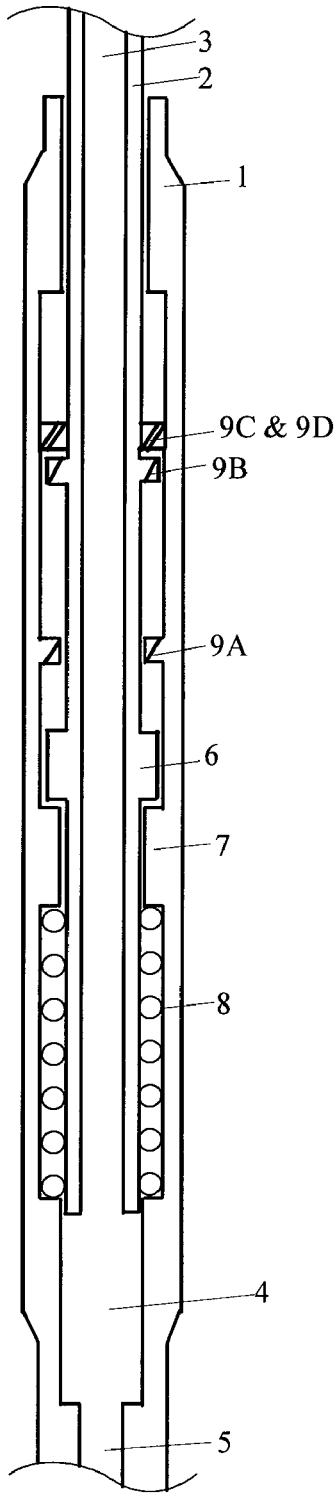
FIG. 4 represents a longitudinal cross section of the tool of the present invention with the inner mandrel in its upward (up-jarring) position. In this position inner splines of the outer housing are disengaged with outer splines of the inner mandrel and the pair of toothed up-jars are engaged, creating vibratory impacts when the inner mandrel is rotated with respect to the outer housing.

Referring now to FIGS. 1, 3 and 4 the tool of the present invention is shown in longitudinal cross-section. Inner mandrel 2 is slidably engaged along the longitudinal axis of outer housing 1. The upper end of inner mandrel 2 will be adapted to couple with adjacent part of the drill string (not shown). The lower end of outer housing 1 will be adapted to couple with adjacent part of the drill string (not shown). Inner mandrel 2 has a longitudinal bore 3 to allow for the passage of drilling fluid from that part of the drill string above to a lower chamber 4 of outer housing 1. The lower end of outer housing 1 also has a longitudinal bore 5 to allow for the passage of drilling fluid from lower chamber 4 to that part of the drill string below. Lower portion 4 of outer housing 1 will be sized to allow for axial movement of the inner mandrel 2 within.

Inner mandrel 2 will have a plurality of longitudinally disposed splines 6 projecting radially outward from a portion of its outer diameter. Conversely outer housing 1 will have a plurality of splines 7 projecting radially inward from a corresponding (when inner mandrel 2 is in an "intermediate" position within outer housing 1; which will be described further herein) portion of its inner diameter. Said splines (6 of inner mandrel 2 and 7 of outer housing 1) are designed to matingly engage with each other when the inner mandrel 2 is in the "intermediate" position within outer housing 1 (as are engagingly shown as "6 & 7" in FIG. 1 and shown axially disengaged in FIGS. 3 & 4). Accordingly it is seen that when inner mandrel 2 is in the "intermediate" position (as is shown in FIG. 1) the inner mandrel 2 and outer housing 1 are prevented from rotating with respect to each other, therefore torque applied to inner mandrel 2 is transmitted to outer housing 1 (and vice versa). Spring 8 (or shear pin, not shown) may be used to keep inner mandrel 2 in the intermediate position until sufficient force to overcome spring 8 (or sever said shear pin) is applied downwardly to said inner mandrel.

Conversely it is seen that said splines (6 of inner mandrel 2 and 7 of outer housing 1) are designed to disengage from each other when the inner mandrel 2 shifted to the "down" position (as is shown in FIG. 3) or to the "up" position (as is shown in FIG. 4). When disengaged torque cannot be applied through splines 6 of inner mandrel 2 and splines 7 of outer housing 1. Rather when inner mandrel 2 is shifted either upwardly (as shown in FIG. 3) or downwardly (as is shown in FIG. 4) from the intermediate position (as is shown in FIG. 1) transmission of torque between inner mandrel 2 and outer housing 1 is designed to be transmitted by a pair of "jars" (either a pair of down-jars or a pair of up-jars).

Figure 2:
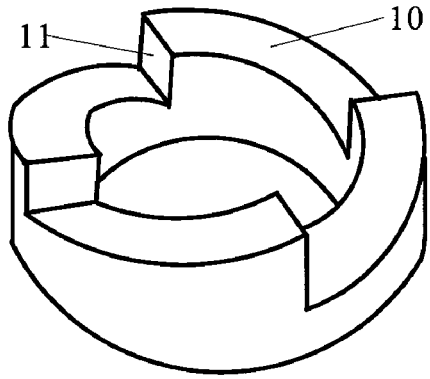
FIG. 2 is an isometric view of one of the "jars" of the present invention.

The invention has four annular, ring-shaped "jars" 9*a*, 9*b*, 9*c* and 9*d* (illustrated disengaged, thus separately, in FIG. 1). Each of said jars has a plurality of "teeth" (as is illustrated in FIG. 2). Each of said teeth has two surfaces, the first 10 gradually ramping up from a lower elevation to a higher-elevation and the second 11 precipitously dropping back down to the lower elevation. Two of said jars 9A and 9B, with teeth facing each other, form the "down-jars" of the present invention. In FIG. 3 said down-jars are engaged. In FIGS. 1 and 4 said jars are shown disengaged. FIG. 1 and FIG. 4 said down-jars are not engaged. Conversely when inner mandrel 2 is shifted upwardly neither splines 6 and 7 nor jars 9A and 9B are engaged, but two other jars 9C and 9D, together forming the "up-jars" of the present invention, become engaged (as is shown in FIG. 4).

It should be appreciated that the invention herein disclosed is not designed to generate vibratory impact forces ("jar") when the inner mandrel 2 and outer housing 1 are rotatably engaged, as described above. Rather said invention is designed to jar when the inner mandrel 2 and outer housing 1 are rotatably disengaged (which is accomplished by axial movement of the inner mandrel 2 in outer housing 2). When they are disengaged jarring is accomplished by application of vertical force (weight or lifting force on the drill string) and rotating the inner mandrel 2 with respect to the outer housing 1.

Jarring forces are generated by the annular ring-shaped jars 9A, 9B, 9C and 9D (operating, as described above, in pairs), each of which has at least one tooth (usually several teeth) which have a profile which is designed to gradually increase axially compressive force between that pair of rings then suddenly release said increased force (cause an "impact" or "jar") as the annular rings of that pair of rings are placed under axial loading and then the teeth rotatably "slipped" over each other. In preferred embodiment this increase and sudden release of compressive forces is created by axially projecting teeth, each of which tooth has a profile having one surface 10 which gradually inclines axially from the root to the tip of the tooth and is followed by (in the direction rotation, usually "right handed" or "clockwise" rotation viewed from the surface of the earth bore) a precipitous return ("sudden drop-off") 11, which will generally be perpendicular to radius of annular ring, from the tip of the tooth to the root thereof. It should be appreciated that the larger the distance from the tip to the root ("height) of the tooth the more energy may be generated and released as an annular ring is placed under axially compression and then rotated with respect the corresponding ring of that pair of rings. It should also be appreciated that both the height of the tooth and the angle of the inclined surface will correspond to how much torque can be applied even when the invention is in the impact mode (the steeper the angle and the greater the height of the tooth the more torque will be applied before an impact occurs).

The invention has at least two pairs of annular ring-shaped jars, one of which pair 9A and 9B is used to generate create downward jarring forces, the other 9C and 9D of which is used to upward jarring forces. One of the annular rings of each pair is attached to the outer surface of the inner mandrel and the other of annular ring of each pair is attached to the inner surface of the outer housing. The tool is designed to be selectively shifted, by axial translation of the inner mandrel 2 with respect to the outer housing 1, between down-jarring, up-jarring, or no-jarring as desired.

In the preferred embodiment this ability to longitudinally shift the inner mandrel 2 with respect to the outer housing 1 is made possible by providing a longitudinal space between each pair of jars, which longitudinal space corresponds to the position where the inner mandrel 2 is rotatably engaged to the outer housing 1. By so positioning the respective structures of the invention it can be seen that when the inner mandrel 2 is rotatably engaged with outer housing 1 the invention is designed to be substantially "transparent", namely transmit rotary and axial forces (similar to an ordinary joint of pipe rather than generate jarring forces), but when the inner mandrel 2 is axially shifted either upward or downward with respect to the outer housing 1, engages one pair of annular rings or the other and can now be used to generate jarring (either up or down, as selected), transmit torque (as a function of height and angle of inclined surface of teeth of the annular rings) and transmit axial loads.

Those skilled in the art will recognize that the tool of the present invention would work as well if installed "upside down" in a drill string, accordingly such embodiment is intended to be comprehended by the invention herein disclosed.

While the above description contains certain specifics, these should not be construed as limitations on the scope of the invention, but rather as an exemplification of one preferred embodiment thereof. Accordingly, the scope of the present invention should be determined not by the embodiment(s) illustrated, but by such claims and their legal equivalents as may later be granted upon patent applications emanating from this application.

What is claimed is:

1. An up and down vibratory drilling and jarring tool comprising:

a. a cylindrical outer housing having an upper end, a lower end, a longitudinal axis running between said ends, an outer diameter and an inner diameter;

b. a cylindrical inner mandrel slidably disposed along the longitudinal axis of said outer housing, said inner mandrel having an upper end, a lower end, a longitudinal axis running between said ends, an outer diameter and an inner diameter;

c. a first set of splines disposed longitudinally attached to and projecting radially inward from a portion of said inner diameter of said outer housing;

d. a second set of mating splines disposed longitudinally attached to and projecting radially outward from a portion said outer diameter of said inner mandrel;

e. a set of upper jars comprising an upper ring shaped structure, having an upper and a lower shoulders, attached to and projecting radially inward from the inner diameter of said outer housing and has a saw-tooth profile projecting axially downward from said lower shoulder and a lower ring shaped structure, having an upper and a lower shoulders, attached to and projecting radially outward from the outer diameter of said inner mandrel and has a mating saw-tooth profile projecting axially upward from said upper shoulder; and, f. a set of lower jars comprising an upper ring shaped structure, having an upper and a lower shoulders, attached to and projecting radially outward from the outer diameter of said inner mandrel and has a saw-tooth profile projecting axially downward from said lower shoulder and a lower ring shaped structure, having an upper and a lower shoulders, attached to and projecting radially inward from the inner diameter of said outer housing and has a mating saw-tooth profile projecting axially upward from said upper shoulder;

g. wherein said first and second set of splines, upper and lower jars are spaced longitudinally apart so that said saw-toothed profiles of the upper jars are engaged, said splines and said lower jars are disengaged when the inner mandrel is shifted to an upward position in said outer housing; said first and second splines are matingly engaged, said upper jars and said are disengaged when the inner mandrel is shifted to an intermediate position in said outer housing, and, said saw-toothed profiles of the lower jars are engaged, said splines and said lower jars are disengaged when the inner mandrel is shifted to an downward position in said outer housing.

2. The apparatus of claim 1 further comprising fluid tight seal between the outer diameter of said inner mandrel and the upper end of said outer housing.

3. The apparatus of claim 2 wherein the upper end of said inner mandrel projects axially upward from said outer housing and is adapted to couple with an adjacent part of a drill string.

4. The apparatus of claim 3 wherein said lower end of said outer housing is adapted to couple with an adjacent part of a drill string.

5. The apparatus of claim 4 wherein said inner mandrel has a longitudinal bore which permits the passage of drilling fluid therethrough.

6. The apparatus of claim 5 wherein the lower end of said outer housing has a longitudinal bore which permits the passage of drilling fluid therethrough.

7. The apparatus of claim 6 further comprising a compression spring disposed below said splines projecting radially inward from said inner diameter of said outer housing, so as to prevent movement of said inner mandrel downward within said outer housing until upward force of said spring is overcome by application of greater force downward upon said inner mandrel.

8. The apparatus of claim 6 further comprising shear pin which couples inner mandrel at intermediate position within said outer housing until sheared by upward or downward force on inner mandrel which exceeds the strength of said pin.

* * * * *